US008456960B1

(12) United States Patent
Terzian et al.

(10) Patent No.: US 8,456,960 B1
(45) Date of Patent: Jun. 4, 2013

(54) HYBRID DIGITAL—ANALOG TIME DISPLAYS

(75) Inventors: Berj A. Terzian, Newbury, MA (US); Robert Alfred Brodmann, North Bergen, NJ (US)

(73) Assignee: Equitime, Inc., Newbury, MA (US)

( * ) Notice: Subject to any disclaimer, the term of this patent is extended or adjusted under 35 U.S.C. 154(b) by 0 days.

(21) Appl. No.: 13/312,523

(22) Filed: Dec. 6, 2011

(51) Int. Cl.
*G04B 25/00* (2006.01)

(52) U.S. Cl.
USPC ..... 368/71; 368/82; 368/242

(58) Field of Classification Search
USPC ..... 368/71, 79, 80, 82, 223, 240
See application file for complete search history.

(56) References Cited

U.S. PATENT DOCUMENTS 4,396,294 A * 8/1983 Yoshida ..... 368/71
4,400,092 A * 8/1983 Piquet et al. ..... 368/82
4,742,501 A * 5/1988 Coster ..... 368/82
5,422,864 A * 6/1995 Lorello ..... 368/223
5,694,376 A * 12/1997 Sullivan ..... 368/82
D434,993 S * 12/2000 Barker ..... D10/126
6,198,698 B1 * 3/2001 Graves ..... 368/82
6,556,513 B2 * 4/2003 Wimberly ..... 368/82
6,714,486 B2 * 3/2004 Biggs ..... 368/82
7,525,877 B2 * 4/2009 Harrison, Jr. ..... 368/82
7,830,752 B2 * 11/2010 Rogers ..... 368/240
2005/0052953 A1 * 3/2005 Kent ..... 368/82
2007/0258336 A1 * 11/2007 Bailey ..... 368/223

* cited by examiner

*Primary Examiner* — Tulsidas C Patel
*Assistant Examiner* — Jason Collins
(74) *Attorney, Agent, or Firm* — Lucas & Mercanti, LLP

(57) ABSTRACT

Hybrid digital-analog time displays are provided to tell time with digital hour and minute values, as well as simultaneous analog tracks that are coordinated in lengths with the minute values. These displays are shown in four successive quadrants and enable users to view current time exactly from the digital values and approximately from the analog tracks.

8 Claims, 1 Drawing Sheet

HYBRID DIGITAL—ANALOG TIME DISPLAYS

BACKGROUND OF THE INVENTION

1. Field of the Invention

This invention relates to new time displays which are composites of digital and analog elements that portray time in a way that provides unique simplicity, balance, and readability.

2. Description of the Prior Art

Cosmologists say that time began from the Big Bang about 13.7 billion years ago. Millions of years afterwards, humans began to evolve, and eventually started resorting to ways for keeping track of time. Examples are the shadows of sticks in the ground, sundials, hour glasses, cracks in stones and rocks, the cycles of sun/moon rise and set, ebb and flow of tides, and the sun's seasonal oscillations.

Several hundred years ago, the first pocket watch was invented, followed by wristwatches, initially analog, then digital, and today myriads of style and functions are extant. The time industry annually produces a large range of timepieces from cheap throwaways to expensive models costing tens to hundreds or even thousands of dollars. Sales also generate a few billions dollars yearly.

All people live for a lifetime, i.e., a finite amount of time. This is the most precious existence one can have. Therefore, time must be used carefully, satisfactorily, and successfully. The raison d'etre for achieving these goals is the engine that has driven production of countless styles and types of time displays and timepieces.

SUMMARY OF THE INVENTION

The present invention creates a composite of digital and analog elements which have been coordinated with each other. This system achieves simplicity, balance and immediate readability to enable tracking time with unprecedented efficiency, satisfaction and confidence.

Other features and details of the invention will be understood from the following drawings and specific descriptions thereof.

DESCRIPTION OF THE DRAWINGS

FIG. 1 depicts a wristwatch that preferably has a circular case 10, a circular bezel 12 and a circular dial 14. At the center of dial 14 is a smaller concentric circle 16 within which the hour "1" is displayed. The vertical and horizontal line segments 17A, 17B, 17C and 17D extending between the bezel 12 and the concentric circle 16 divide dial 14 into four curved quadrants 18, 20, 22 and 24, respectively, see FIG. 4.

Figure 1:
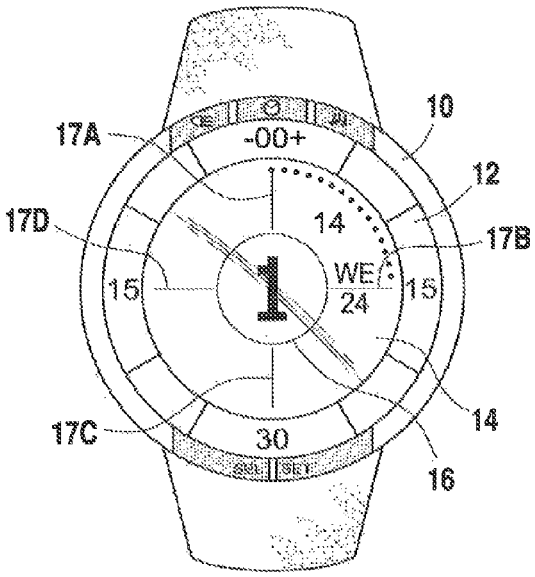
FIG. 1 is an initial drawing of a wristwatch that depicts a first phase of the present invention.

Bezel 12 is inscribed at the top with a double zeros mark "00". The right side of 00 is inscribed with a "+" mark. The left side is inscribed with a "−" mark.

Horizontal edges of bezel 12 are inscribed with minute values 15, and the vertical bottom edge of bezel 12 is inscribed with minute value 30. The four quadrants 18, 20, 22 and 24 are bordered by four curved bezel segments, each of which of which is inscribed with two short equally spaced radial line segments 12A which, together with the minute values inscribed on the bezel, divide each quadrant into twelve 5 minute partitions, see FIG. 2.

Figure 2:
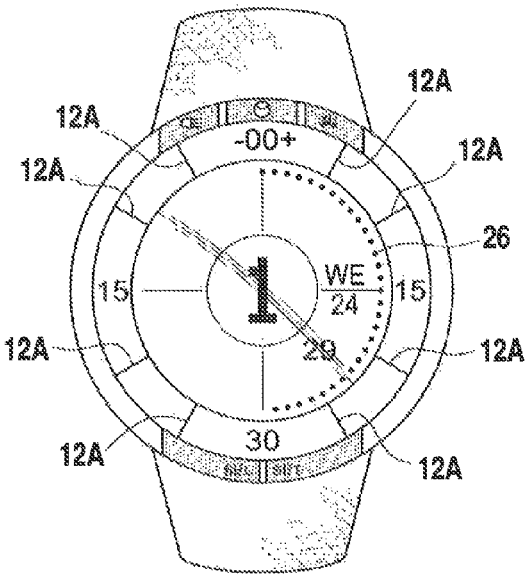
FIG. 2 is a second drawing that depicts a second phase.

Adjacent the curved inner bezel border segments are a series of small dots 26, see FIG. 2. These are coordinated as analog LCD minute pixels each being equivalent to a minute location and value. These pixels create analog tracks of the progression of time values, as will be explained below.

FIG. 1 depicts the beginning of hour 1, with 00 minutes. When the first minute is reached, minute value 01 appears in the approximate center of quadrant 18. Simultaneously, the first pixel 26 appears adjacent the curved inner border of bezel 12. Thus, the first minute after hour 1 is both digitally defined and also pixelated as the initial step of a corresponding and coordinated analog track.

From this point on, all subsequent values of up to 15 minutes are displayed at the stationary central location of quadrant 18, with the coordinated appearances of the corresponding pixels 26. Thus, a lengthening curved set of tracks is formed by the pixels 26 at the inner rim of bezel 12, which function as an analog of the completion of the first quarter of hour 1. The specific time displayed in FIG. 1 is 14 minutes past 1.

FIG. 2 similarly displays the next quarter hour that begins with minute 16 in the stationary central location of quadrant 20 with the corresponding coordinated pixel 26. These progressive minute values continue until the completion of minutes 16 to 30 are displayed, as well as the corresponding thirty pixels that form analog tracks which mark the completion of the first half hour by quadrants 18 and 20. The specific time displayed in FIG. 2 is 29 past 1.

Figure 3:
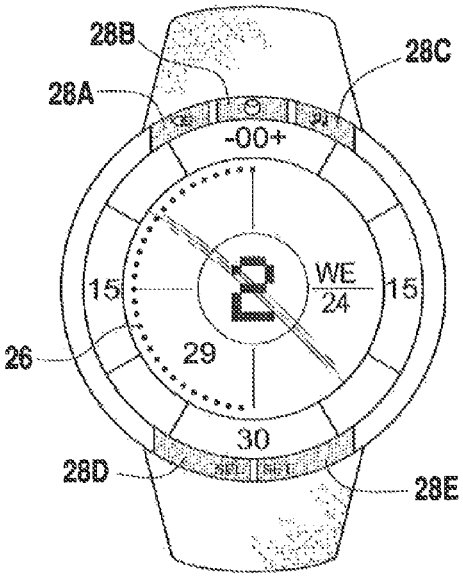
FIG. 3 is a third drawing that depicts a third phase.

FIG. 3 illustrates four changes which initiate the second half of the hour. After 30 minutes, the value of the next minute in quadrant 22 reduces to 29, the completed analog tracks during the first half hour extinguishes, another set of analog tracks appears extending from minute value 29 to the top of the bezel 12, and the hour value increases to "2". Thus, the display shifts to a mode which defines that the time is 29 minutes until the beginning of the next hour 2.

Figure 4:
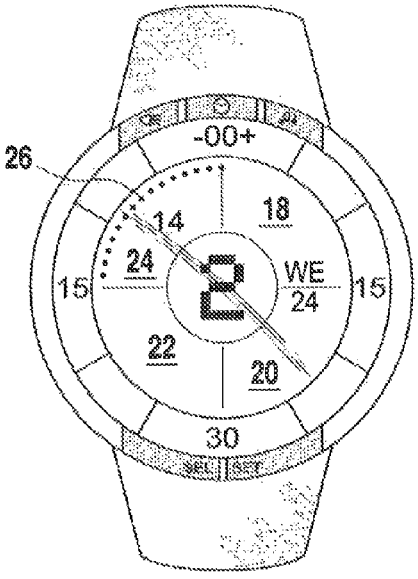
FIG. 4 is a fourth drawing that depicts a fourth phase.

From this point on, the minutes incrementally decrease one-by-one toward value 15 on the left side of dial 14, and the pixels 26 are simultaneously extinguished one-by-one to shorten the length of the analog tracks extending along bezel 12 toward the top of the dial 14. In other words, the display depicts the diminishing amount of time that remains until the beginning of next hour 2. This progression is displayed digitally and in analog fashion by the disappearing tracks of pixels 26 toward the end of hour 1 and the beginning of hour 2. This point in time is reached by the progressions shown in quadrant 22 of FIG. 3, followed by those continued in quadrant 24 of FIG. 4, which displays the specific time of 14 minutes to 2.

The principal features of the invention have been portrayed and explained. The dial 14 is divided into four curved quadrants. Each quadrant is successively activated to display the current time, while the other three are empty but also geometrically outlined by the quadrant cross border lines, 17A, 17B, 17C, and 17D.

The analog tracks cross into and through two successive pairs of quadrants. The first pair of quadrants indicates that the first half hour portrays elapsed time past the current hour. The second pair of quadrants portrays how much time remains until the beginning of the next hour. The symbols + and − that flank 00 on the right and left sides of the bezel 12 indicate that the watch displays initially elapsed time and thereafter forward time during every hour.

The above noted features create complete balance and equality of the two halves of each hour, as in the natural motions of nature cited above. Therefore, this system of digital exactitude, coordinated with graphic analog approximation, provides time displays that are very useful for virtually all conceivable timekeeping needs during normal daily tasks or play. It should also be noted that the first two quadrants display the day name and date, specifically Wednesday, i.e. ("WE") and the current month's $24^{th}$ day, which are frequently useful to know.

In 2006, applicants' assignee, Equitime, Inc, introduced a new digital watch called QUADTEC. It was operated with five push buttons 28A, 28B, 28C, 28D and 28E marked with identifying icons, namely; a lamp emitting light beams (for lighting the display in the dark); a watch face showing 10 past 10 (for switching the display into a setting mode); a three tone musical melody (for switching the display into an alarm setting mode), and two more buttons marked with SEL and SET (for selecting and setting time modes and values), see FIG. 3. Similar buttons and functions are included in drawings of the present invention. These buttons and their operation are described in more detail in U.S. Pat. No. 7,187,624, which is incorporated herein by reference.

Manufacture of a module for the above described watch face can be readily accomplished by preparing an object code and then programming it in the ROM of a silicon LCD chip. The same technique was used in manufacturing the previous QUADTEC watch in 2006.

The invention has been described by its functional principles and specific embodiments. Many variations of this disclosure will be obvious to those skilled in the art. Therefore, it should be understood that the ensuing claims are intended to cover all changes and modifications of the illustrative embodiments which fall within the literal scope of the claims and all equivalents thereof.

The following is claimed:

1. Hybrid time displays comprising (a) digital elements which generate and display hour and minute values, and (b) non-numeric analog elements which generate and display graphic analog tracks in lengths coordinated with the magnitudes of the minute values, wherein the tracks progress longer as the minute values rise from zero to 30, and wherein the tracks progress shorter as the minute values diminish from 29 to zero.

2. Displays as in claim 1 wherein the tracks are incrementally generated and displayed one-by-one, each coordinated to each minute value.

3. Displays as in claim 2, wherein each track is displayed as a pixel representative of each minute value.

4. Displays as in claim 3, wherein tracks grow in lengths coordinated with rising minute values from 01 to 30, and tracks become shorter in lengths coordinated with diminishing minutes from 29 to zero.

5. A wristwatch provided with a hybrid time display comprising:

(a) a circular case, a circular bezel and a circular dial;

(b) a smaller concentric circle positioned approximately in the center of the dial which displays hour values;

(c) vertical and horizontal cross lines between the concentric circle and the bezel which divide the dial into four curved quadrants;

(d) the first two quadrants display successive minute values from zero to 15, followed by 16 to 30, and analog tracks grow longer in length in coordination with the rising minute values; and (e) the remaining two quadrants display successive minute values from 29 to 15, followed by 14 to zero, and analog tracks become shorter in length in coordination with the diminishing minute values.

6. A wristwatch as in claim 5 wherein the analog tracks in the first and second quadrants are extinguished upon appearance of minute value 29 in the third quadrant, and analog tracks simultaneously are displayed in the third and fourth quadrants as minute values reduce from 29 to 15, followed by 14 to zero, with the tracks becoming shorter in length in coordination with the diminishing minute values.

7. A wristwatch as in claim 5, wherein the top of the bezel is inscribed from left to right with a minus-mark, double zeros 00, and a plus + mark, respectively.

8. A wristwatch as in claim 5, wherein the day name and day date are displayed in the first two quadrants.

* * * * *